US005737946A

United States Patent [19]

Sole et al.

[11] Patent Number: 5,737,946

[45] Date of Patent: Apr. 14, 1998

[54] SEMI-TRAILER ANTI-THEFT DEVICE

[76] Inventors: Jeffrey S. Sole, 440 E. 116th Ave., Northglenn, Colo. 80233; Harlan K. Sole, 7722 Shoshone St., Denver, Colo. 80221

[21] Appl. No.: 724,525

[22] Filed: Sep. 30, 1996

[51] Int. Cl.[6] ..... E05B 67/38

[52] U.S. Cl. ..... 70/54; 70/56; 70/158; 292/DIG. 32; 292/104; 292/205

[58] Field of Search ..... 70/54–56, 158–161; 292/104, 205, DIG. 29, 32

[56] References Cited

U.S. PATENT DOCUMENTS

| | | | |
|---|---|---|---|
| 1,244,404 | 10/1917 | Ankovitz | 70/56 |
| 1,245,554 | 11/1917 | Bell . | |
| 1,248,203 | 11/1917 | Ellington | 70/56 |
| 3,943,738 | 3/1976 | Foote | 70/54 X |
| 4,191,034 | 3/1980 | Froess et al. | 70/56 X |
| 4,566,296 | 1/1986 | Kochakis | 70/56 |
| 4,581,907 | 4/1986 | Eberly | 70/54 |
| 4,704,881 | 11/1987 | Sloop, Sr. | 70/158 |
| 4,843,845 | 7/1989 | Poe | 70/54 |
| 4,843,846 | 7/1989 | Wagner | 70/54 X |
| 4,852,920 | 8/1989 | DeForrest, Sr. | 292/205 |
| 4,895,007 | 1/1990 | Eberly | 70/54 |
| 4,896,518 | 1/1990 | Appelgren | 70/54 |
| 4,898,008 | 2/1990 | Eberly | 70/56 |
| 5,036,684 | 8/1991 | Zivanovic | 70/161 |
| 5,063,764 | 11/1991 | Amis et al. | 70/100 |
| 5,168,258 | 12/1992 | Raake | 70/54 X |
| 5,257,839 | 11/1993 | Nielsen et al. | 292/205 X |
| 5,284,036 | 2/1994 | Rosenbaum | 70/56 X |
| 5,507,539 | 4/1996 | Basinski | 292/DIG. 32 X |

FOREIGN PATENT DOCUMENTS

| | | | |
|---|---|---|---|
| 2582038 | 11/1986 | France | 292/205 |

*Primary Examiner*—Suzanne Dino
*Attorney, Agent, or Firm*—Fields & Johnson, P.C.

[57] ABSTRACT

A semi-trailer anti-theft device or apparatus is provided in the form of a shield which extends over and substantially encloses both the latch handle on the cargo door of a semi-trailer and the padlock associated with the latch. The shield includes an elongated front panel which extends across the latch handle. At a first end of the front panel on the rear side thereof is a forked member which can be inserted around the pivot pin of the latch handle and then the shield can be swung down about the pivot pin so as to bring the front panel of the shield into covering alignment with the latch handle. A second end of the front panel is in the form of a padlock guard having a rearwardly extending flange which extends over the top of the padlock and a lock plate protecting the face of the padlock. Also a locking web extends rearwardly from the second end of the front panel below the flange and has an aperture through which the padlock bight extends.

9 Claims, 3 Drawing Sheets

SEMI-TRAILER ANTI-THEFT DEVICE

TECHNICAL FIELD

This invention relates to an anti-theft device or apparatus for a semi-trailer and more particularly to such a device which protects both the latch arm and the padlock on the cargo door of a semi-trailer from undesirable access thereto.

BACKGROUND ART

Maintaining the security of the contents of a semi-trailer during transportation and storage of the contents within the trailer is an ongoing problem. Various attempts have been made to improve the security of semi-trailers. Prior to the present invention, most prior art devices have been directed to protecting the padlock attached to the latch arm. However, tools, such as bolt cutters, are available which can cut through the latch arm almost as easily as cutting through the padlock.

Examples of devices which only protect the padlock are U.S. Pat. No. 4,895,007 to Eberly, U.S. Pat. No. 4,581,907 to Eberly and U.S. Pat. No. 4,898,008 to Eberly. U.S. Pat. No. 4,896,518 to Appelgren; U.S. Pat. No. 1,244,404 to Ankovitz; and U.S. Pat. No. 1,248,293 to Ellington also disclose padlock protector shields to prevent access to a padlock.

While each of these prior art devices is satisfactory for their intended purpose, none protects the arm of the latch of a semi-trailer from tampering.

DISCLOSURE OF THE INVENTION

In accordance with this invention, a semi-trailer anti-theft device is provided in the form of a shield which extends over and substantially encloses both the latch on the cargo door of a semi-trailer and the padlock associated with the latch. The shield includes an elongated front panel which extends across the latch handle. At a first end of the front panel on the rear side thereof is a forked member which can be inserted around the pivot pin of the latch handle and then the shield can be swung down about the pivot pin so as to bring the front panel of the shield into covering alignment with the latch handle. A second end of the front panel is in the form of a padlock guard having a rearwardly extending flange which extends over the top of the padlock and a lock plate protecting the face of the padlock. Also a locking web extends rearwardly from the second end of the front panel below the flange and has an aperture through which the padlock bight extends.

Additional advantages of this invention will become apparent from the description which follows, taken in conjunction with the accompanying drawings.

BEST MODE FOR CARRYING OUT THE INVENTION

Figure 1:
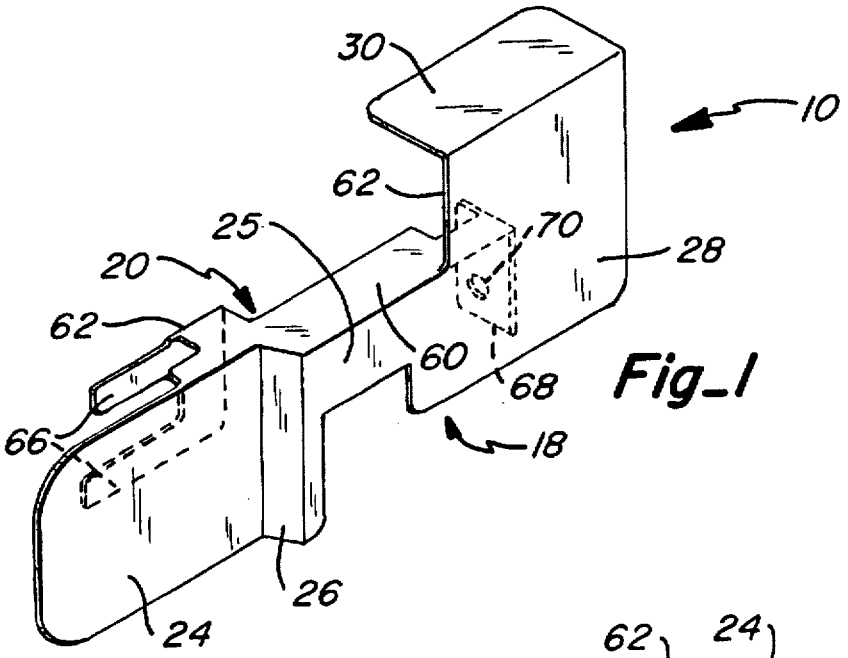
FIG. 1 is a front perspective view of the semi-trailer anti-theft device of this invention.
Figure 2:
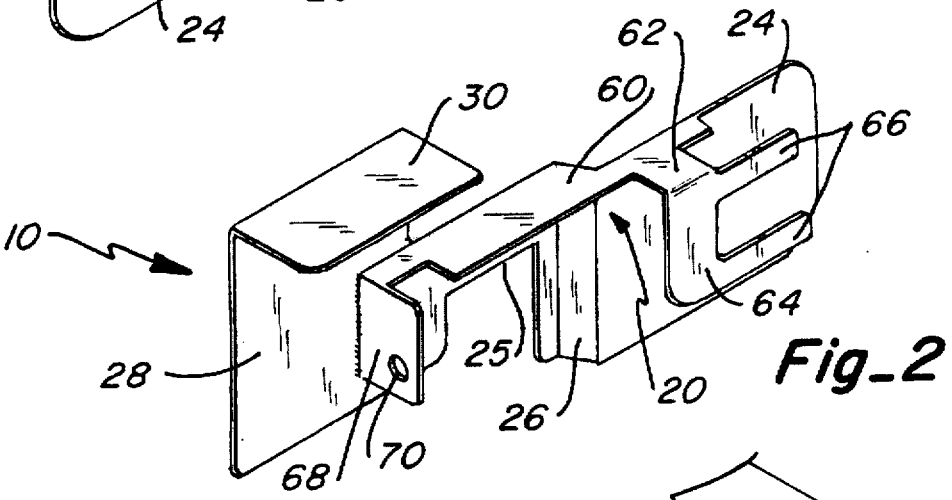
FIG. 2 is a rear perspective view of the device of FIG. 1.
Figure 3:
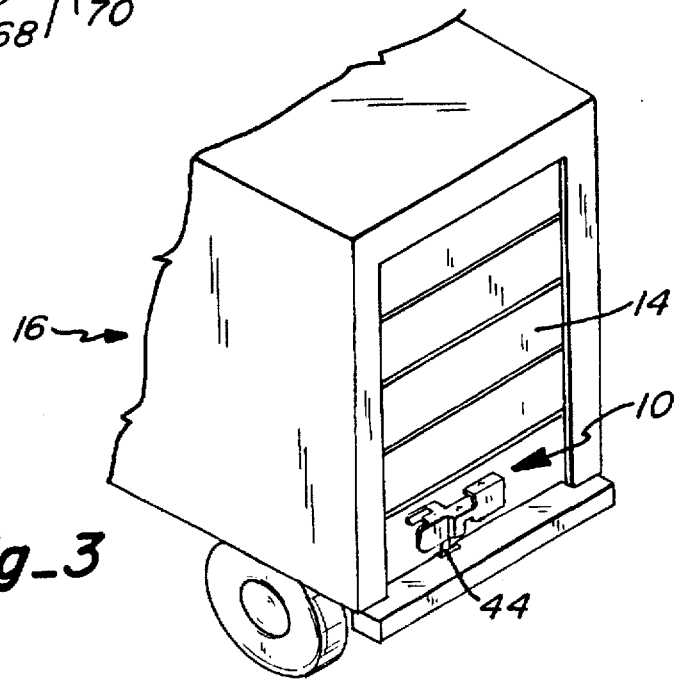
FIG. 3 is a fragmentary perspective view of a semi-trailer showing the anti-theft device of this invention installed thereon.
Figure 8:
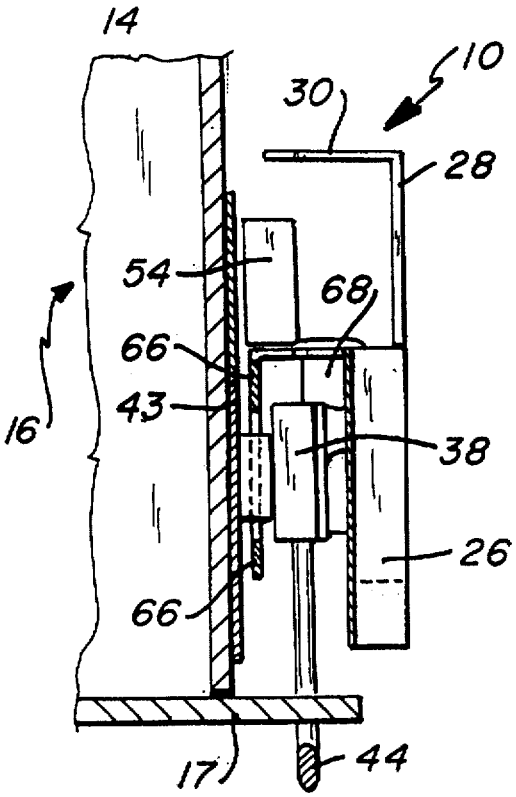
FIG. 8 is an enlarged vertical section, taken along line 8—8 of FIG. 6, showing how the forked member engages the pivot pin.

In accordance with this invention, as shown in FIGS. 1–3, an anti-theft device 10 is provided for attachment to and protection of the latch 12 on cargo door 14 of a semi-trailer 16. When cargo door 14 is closed, it abuts floor 17, as shown in FIG. 8. Conveniently, anti-theft device 10 is made from two pieces, namely elongated front cover plate 18 and an elongated securing member 20 attached to the rear side of plate 18 for anchoring the anti-theft device in place to protect latch 12 and padlock 22 (see FIG. 6). Advantageously, cover plate 18 and securing member 20 are made of high impact 10 gauge steel or other similarly hard material which cannot be cut with bolt cutters or other similar devices. It will be understood that anti-theft device 10 can be made as a single piece or as multiple pieces, all as will be apparent to one of ordinary skill in the art.

More particularly, cover plate 18 has a first offset forward pivot pin panel 24 connected to a neck 25 by an offset plate 26. The opposite or rear end of cover plate 18 includes a large padlock covering plate 28 which has a rearwardly extending padlock cover plate or top flange 30 which extends over and covers the top of the padlock. Advantageously, the offset plate 26 provides the necessary space for handle 34 of latch 12 which has an opening 46, as best seen and FIG. 7.

Figure 4:
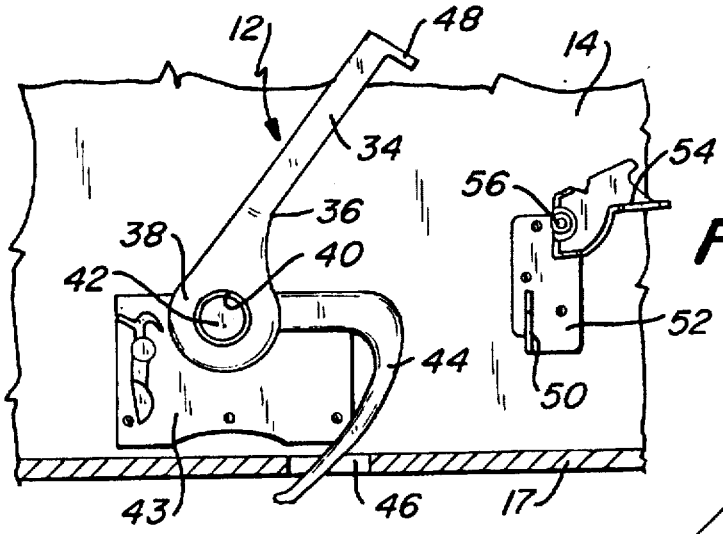
FIG. 4 is a fragmentary side elevation showing a latch for the cargo door of a semi-trailer on which the anti-theft device of this invention is used.
Figure 5:
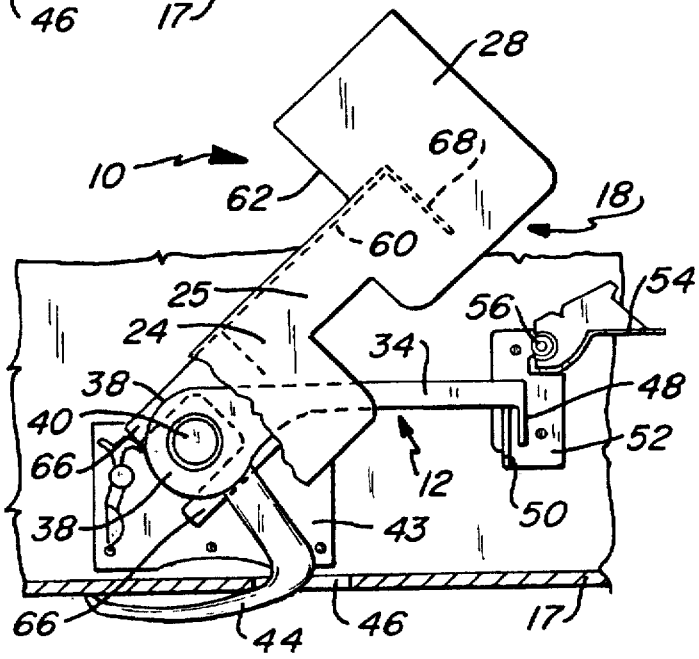
FIG. 5 is a fragmentary side elevation, similar to FIG. 4, but showing the anti-theft device with the forked member inserted around the latch arm pivot pin.
Figure 6:
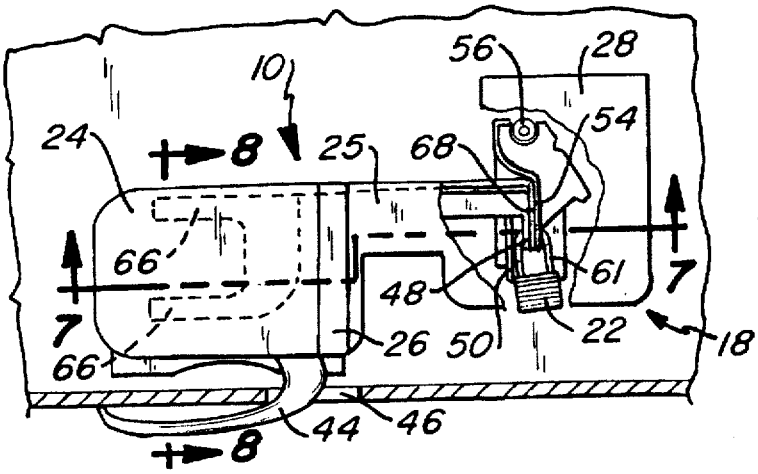
FIG. 6 is a fragmentary side elevation, with parts broken away for clarity of illustration, showing the anti-theft device pivoted to its operative position.
Figure 7:
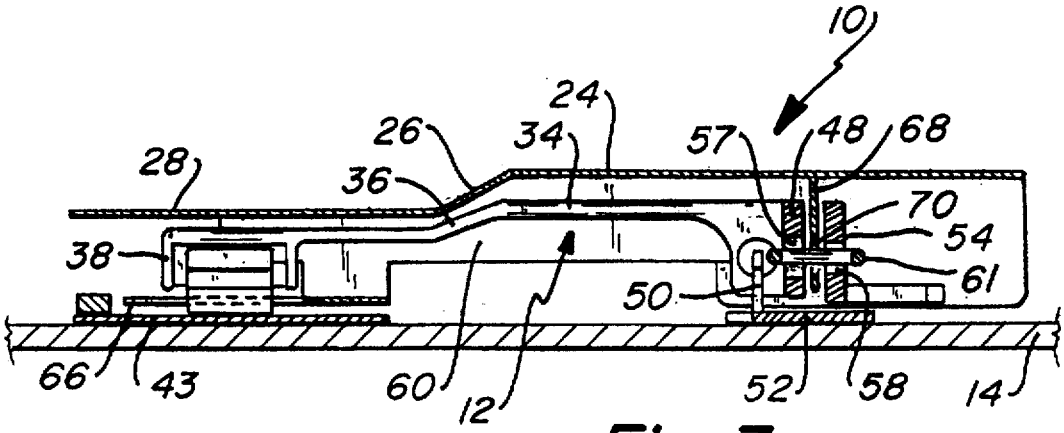
FIG. 7 is an enlarged offset horizontal section, taken along line 7—7 of FIG. 6, showing details of how the anti-theft device is locked in place.

As best seen in FIG. 4, handle 34 has a forward or first pivot end 38 with an opening 40 for pivotal mounting on pivot pin 42, which is secured to a mounting plate 43 attached to cargo door 14. Extending from pivot end 38 is an angular claw 44 which extends through an opening 46 in floor 17 of semi-trailer 16 for locking the cargo door when it is closed. As best illustrated in FIGS. 4–6, by rotating arm 34 in a clockwise direction about pivot pin 42, claw 44 will extend through opening 46 and engage the underside of floor 17. The second or distal end of arm 34 has a depending padlock flange 48 which moves into a position adjacent flange 50 of locking bracket 52 attached to cargo door 14, as shown. Conveniently, locking bracket 52 also has a locking flange 54 mounted for rotational movement about pivot 56. Thus, when latch 12 is in the locked position shown in FIG. 5, locking flange 54 can be swung to the closed position shown in FIG. 6. As best seen in FIG. 7, padlock flange 48 has an opening 57 and locking flange 54 has a corresponding opening 58 for receiving the bight 61 of padlock 22 as more fully explained below. From FIGS. 3 and 6, it can be seen that cover plate 18 completely covers the latch 12, padlock 22 and the associated structure.

In order to hold cover plate 18 in position over latch 12, padlock 22 and the associated structures, securing member 20 is provided. This securing member is attached to the back surface of cover plate 18, as by welding. Securing member 20 includes an upper flange 60 extending substantially horizontally or perpendicularly from the upper edges of pivot pin panel 24, neck 25 and the forward vertical edge of lock plate 28. Near the forward end of upper flange 60 is a rearwardly extending web 62 having a forked member 64 depending therefrom. Forked member 64 has a pair of spaced tines 66. The opposite or rear end of upper flange 60 terminates in a rearwardly extending locking web 68 having an aperture 70 therethrough for receiving bight 61 of padlock 22, as discussed below.

When the cargo door 14 is to be secured, latch 12 is swung in a clockwise direction about pivot pin 42 from the position shown in FIG. 4, through the position shown in FIG. 5 and finally to the closed and locked position shown in FIG. 6. Next, anti-theft device 10 is positioned as shown in FIG. 5 so that tines 66 encircle pivot pin 42 behind pivot end 38 of handle 34. Anti-theft device 10 then is pivoted in a clockwise direction to the position shown in FIG. 6. When in this position, aperture 70 in locking web 68 is aligned with opening 57 in padlock flange 48. Locking flange 54 is swung in a counterclockwise direction about pivot 56 so that opening 58 in locking flange 54 is also aligned with aperture 70. Now, the bight 61 of padlock 22 can be inserted through opening 57, aperture 70 and opening 58, respectively, to hold latch 12 and anti-theft device 10 in locked position.

From the foregoing, the advantages of this invention are readily apparent. Cover plate 18, together with padlock cover plate 30, upper flange 60 and locking web 68 covers latch 12 and padlock 22 so that access cannot be had thereto to cut or otherwise tamper with them. The cover plate 18 is secured in place by a first member, such as forked member 64, at one end and by a second member, such as locking web 68, at the other end which is secured by padlock 22. While the padlock can be accessed by a key, access by any other means is prohibited. Thus, a method has been devised which prevents undesirable access to the latch and padlock.

Although a preferred embodiment of the invention has been illustrated and described, it should be understood that various changes and modifications can be made without departing from the spirit and scope of this invention.

What is claimed is:

1. A semi-trailer anti-theft apparatus for inhibiting access to a cargo door, said apparatus comprising:

a latch attached to said cargo door at a pivot point; said latch being pivotable about said pivot point in a plane substantially parallel to the cargo door;

a lock engageable with said latch for locking said latch with respect to the cargo door;

an elongated panel extendable along said latch and over said lock on the cargo door, said elongated panel having a first end and a second end;

a forked member attached to said elongated panel at said first end thereof for engagement with said latch adjacent said pivot point so that said elongated panel is extendable from said pivot point along said latch;

a pivot pin panel located adjacent said first end for covering said pivot point; and a locking web attached to said elongated panel at said second end thereof and having an aperture through which said lock is engaged.

2. Apparatus, as claimed in claim 1, wherein said elongated panel has an upper edge and a back side, said apparatus further comprising:

an elongated upper flange attached along said upper edge extending rearwardly from said back side.

3. Apparatus, as claimed in claim 2, wherein:

said forked member depends from said upper flange.

4. An anti-theft apparatus for inhibiting access to a cargo door, said apparatus comprising:

a latch having a first end and a second end, said latch being pivotably connected to said cargo door at said first end thereof in a plane substantially parallel to the cargo door;

a lock engageable with said second end of said latch;

a cover plate, having a first end and a second end, and positionable over said latch and said lock;

a first member connected to said cover plate for securing said first end of said cover plate to said first end of said latch;

a second member connected to said second end of said cover plate for securing said second end of said cover plate to said lock; and a panel at said first end of said cover plate covering said pivotally connected first end of said latch.

5. Apparatus, as claimed in claim 4, wherein said cover plate further includes:

an offset to accommodate an offset in said latch intermediate said first and second ends of said cover plate; and a flange extendable from said second end of said cover plate over said lock.

6. Apparatus, as claimed in claim 4, wherein said first member includes:

a forked member formed thereon.

7. Apparatus, as claimed in claim 4, wherein said second member includes:

a locking web formed thereon, said locking web including an aperture formed therethrough for receiving a portion of said lock.

8. A method of minimizing undesirable access to a latch handle pivotable about a pivot pin on a semi-trailer cargo door secured by a padlock, said method comprising the steps of:

providing an anti-theft device which has an elongated front panel with a forked member at a first end thereof positioned rearwardly of the elongated front panel and a padlock covering panel at a second end thereof with a rearwardly extending flange for covering the padlock with a locking web therebelow;

inserting the forked member around the pivot pin;

swinging the anti-theft device about the pivot pin to position the locking web in a locking position;

inserting the bight of a padlock through the locking web to lock the anti-theft device in position over the latch handle and padlock.

9. A method of inhibiting access to a cargo door, said method comprising the steps of:

providing a latch with a pivot point from which to rotatably attach the latch to the cargo door;

providing a lock engageable with the latch;

providing an anti-theft device which has a cover plate, and a first and second member attached to the cover plate;

engaging the first member around the pivot point of the latch;

positioning the cover plate over the latch;

rotating the latch and anti-theft device to place the latch in a locked position; and positioning the lock through the anti-theft device and latch resulting in said cover plate covering the latch and the lock.

* * * * *